US011732897B2

(12) United States Patent
Zhou

(10) Patent No.: US 11,732,897 B2
(45) Date of Patent: Aug. 22, 2023

(54) STREAMER TYPE FLAME SIMULATION DEVICE

(71) Applicant: NINGBO RICHEN ELECTRICAL APPLIANCE CO., LTD, Ningbo (CN)

(72) Inventor: Yin Zhou, Ningbo (CN)

(73) Assignee: NINGBO RICHEN ELECTRICAL APPLIANCE CO., LTD, Ningbo (CN)

( * ) Notice: Subject to any disclaimer, the term of this patent is extended or adjusted under 35 U.S.C. 154(b) by 709 days.

(21) Appl. No.: 16/804,825

(22) Filed: Feb. 28, 2020

(65) Prior Publication Data

US 2021/0180795 A1 Jun. 17, 2021

(30) Foreign Application Priority Data

Dec. 13, 2019 (CN) ..... 201922230117.X

(51) Int. Cl.

| | |
|---|---|
| ***F24C 7/00*** | (2006.01) |
| ***F21S 10/04*** | (2006.01) |
| ***F24C 7/08*** | (2006.01) |
| ***F24C 15/00*** | (2006.01) |
| ***F24C 15/06*** | (2006.01) |
| ***F24C 15/08*** | (2006.01) |
| *F24C 3/00* | (2006.01) |
| *F24B 1/18* | (2006.01) |

(52) U.S. Cl.

CPC ..... *F24C 7/004* (2013.01); *F21S 10/046* (2013.01); *F24C 7/081* (2013.01); *F24C 15/004* (2013.01); *F24C 15/06* (2013.01); *F24C 15/08* (2013.01); *F24B 1/1808* (2013.01); *F24C 3/006* (2013.01)

(58) Field of Classification Search

CPC ..... F24C 7/004; F24C 7/081; F24C 15/004; F24C 15/06; F24C 15/08; F24C 3/006; F21S 10/046; F21S 10/04; F24B 1/1808

USPC ..... 392/348; 431/125; 40/428

IPC ..... F24C 7/00,15/00, 15/06; F21S 10/04

See application file for complete search history.

(56) References Cited

U.S. PATENT DOCUMENTS

| | | | | |
|---|---|---|---|---|
| 2,285,535 A * | 6/1942 | Schlett | ..... | F24C 7/004 40/428 |
| 3,395,475 A * | 8/1968 | Moss | ..... | F24C 7/004 40/428 |
| 5,678,534 A * | 10/1997 | Fleming | ..... | F24B 1/006 126/92 R |

(Continued)

FOREIGN PATENT DOCUMENTS

| | | |
|---|---|---|
| CN | 2402937 Y | 10/2000 |
| CN | 2597865 Y | 1/2004 |

*Primary Examiner* — Steven B McAllister
*Assistant Examiner* — Daniel E. Namay
(74) *Attorney, Agent, or Firm* — Charles C. Achkar; Ostrolenk Faber LLP.

(57) ABSTRACT

A streamer type flame simulation device includes a casing, some cross-flow fans disposed inside the casing, a first streamer, a second streamer, a supplementary air-supplying device and a light source. The supplementary air-supplying device is arranged in the split joint area between the two cross-flow fans. Since a supplementary air-supplying device is provided between two cross-flow fans for supplying air, the deficiency where air was unable to deliver at the space occupied by the drive motor of the cross-flow fans can be avoided. Various parts of the first streamer and the second streamer can be blown, thus preventing the flame from being cut off and enhancing the overall coordination, which greatly improves the viewing effect of the flame area.

19 Claims, 9 Drawing Sheets

(56) References Cited

U.S. PATENT DOCUMENTS

| | | | | |
|---|---|---|---|---|
| 6,302,555 | B1 * | 10/2001 | Bristow | F24C 7/004 362/253 |
| 7,162,820 | B2 * | 1/2007 | Hess | F24C 7/004 472/65 |
| 7,194,830 | B2 * | 3/2007 | Hess | F24C 7/004 40/428 |
| 7,300,179 | B1 * | 11/2007 | LaDuke | F21V 5/043 362/244 |
| 8,081,872 | B2 * | 12/2011 | Wang | F24C 7/004 392/350 |
| 2002/0175215 | A1 * | 11/2002 | Webster | F24C 7/004 237/55 |
| 2004/0060213 | A1 * | 4/2004 | Schroeter | F21S 10/04 40/428 |
| 2004/0114351 | A1 * | 6/2004 | Stokes | F24C 7/004 362/811 |

* cited by examiner

STREAMER TYPE FLAME SIMULATION DEVICE

CROSS-REFERENCE TO RELATED APPLICATIONS

The present application claims priority to China Application No. 201922230117.X, filed Dec. 13, 2019, the subject matter of which is incorporated herein in its entirety.

TECHNICAL FIELD

The present invention relates to the technical field of flame simulation devices, in particular to a streamer type flame simulation device.

BACKGROUND

Electric fireplace not only serves the function of heating, decoration, and beautification, but due to its heating by utilizing electric power which is clean and hygienic, it has become more and more popular with consumers.

In prior art, many electric heating fireplaces use streamers to produce flame simulation effect. For example, the flame simulation device described in patent "CN03232928.8-Simulating electric heating fireplaces", blows air on streamers through a fan, so that the streamers are disturbed, and then the light is projected on the streamers to form the shape of a flame. However, the flame of the electric heating fireplace is generally in long strip-shaped, and the fans used are generally cross-flow fans, such as the fans used in the flame simulation device mentioned in patent "CN99247747.6-Electric heating decorative fireplace".

However, with improvement of living standards, requirements for the ornamental performance of electric fireplaces have become higher and higher, and some electric fireplaces with ultra-wide viewing areas have also appeared. The wider the viewing area, the longer will be the flame area, and the cross-flow fan used must also be longer. After the cross-flow fan is lengthened, the manufacturing precision of the fan will be very high. The fan shaft, the fan drive motor, and the fan wheel must have good co-axiality. Otherwise, the vibration due to eccentricity will cause a lot of noise, and the life of the fan will also be greatly reduced. Therefore, in the flame simulation of the ultra-wide viewing area, two or more cross-flow fans are used to blow to the streamer for flame simulation. The drive motor of the cross-flow fan is on the side of the volute of the fan. Surely air cannot be blown towards the area between two cross-flow fans due to the existence of the drive motor, so that the streamer at the junction will not be disturbed and simulate a flame. This greatly reduces the ornamental effect of the electric fireplace.

SUMMARY OF INVENTION

The technical problem to be solved by the present invention is to overcome the technical defects of the background art and provide a streamer type flame simulation device. The structure of the present invention is used for the flame simulation of the electric heating fireplace. A supplementary air-supplying device is provided in the split joint area between the two cross-flow fans, and the supplementary air-supplying device blows air to the second streamer at the split joint area of the cross-flow fans to form disturbance of the second streamer, and combined with the disturbance of the first streamer blown by the cross-flow fan to simulate the shape of a streaming flame, thus performing the flame simulation, preventing the flames in the viewing area from being cut off, which allows it to tend to be consistent. It enhances the overall coordination, and greatly improves the viewing effect. It is suitable for use by flame simulation devices for most electric fireplaces.

The technical solution adopted by the present invention to solve the above technical problems is as follows:

A streamer type flame simulation device, which includes a casing, some cross-flow fans disposed inside the casing, a first streamer, a second streamer, a supplementary air-supplying device, and a light source. There are total of two or more cross-flow fans. The first streamer is a series of strips arranged vertically according to the width direction, and the cross-flow fans are arranged along the width of the first streamer. The second streamer is a strip. The supplementary air-supplying device is arranged in the split joint area between the two cross-flow fans. The cross-flow fans blow air to the first streamer, and the supplementary air-supplying device blows air to the second streamer. The light emitted from the light source is directed towards the first streamer and the second streamer.

Further, the supplementary air-supplying device is a fan.

Further, the first streamer and/or the second streamer are respectively made of flexible materials.

Further, the surface of the first streamer and/or the second streamer has a light reflection effect.

Further, the cross-flow fans are matched and connected with the bottom plate of the casing.

Further, the cross-flow fans are disposed below the first streamer.

Further, an upper bracket and a lower bracket are respectively provided on the upper and lower portions of the back plate of the casing. The upper end of the first streamer is matched and connected with the upper bracket. The lower end of the first streamer is matched and connected with the lower bracket.

Further, the cross-flow fan includes a cross-flow fan air outlet. The first streamer faces the middle of the cross-flow fan air outlet. That is, when the cross-flow fan blows toward the first streamer, there is an air flow in front and at the back of the first streamer, and the speed of air flow obtained at the lower end of the first streamer is stable, but the disturbance caused by air flow at the upper end is stronger, so that a better simulation of flame with steady combustion effect at the bottom is achieved, and the top of the flame is agile and elegant.

Further, the cross-flow fan includes a cross-flow fan drive motor disposed beside the cross-flow fan air outlet. The split joint area includes the upper side of the area where the cross-flow fan drive motor is located.

Further, the fan is matched and connected with the back plate of the casing.

Further, the fan is disposed below the second streamer.

Further, the fan includes a fan air outlet and a mounting panel that is matched and connected with the fan air outlet. A mounting bracket is provided in the middle of the mounting panel. The lower end of the second streamer is matched and connected with the mounting bracket. The fan blows towards the front and rear portions of the second streamer.

Further, the upper end of the second streamer is matched and connected with the upper mounting bracket.

Further, the width of the fan air outlet is less than or equal to the width of the split joint area.

Further, there are two or more light sources.

Further, the light sources are independently controlled, and each of the light sources can emit light of different colors and brightness. Through the combination of controlling two or more light sources with different colors and brightness, different flame effects are formed.

Further, when working stably, the brightness and color of light sources dynamically change according to a certain regular pattern, so that a dynamic flickering effect of the burning flame can be formed.

Further, the color of the light emitted by the light source is similar to the color of a flame.

Further, the color of the light emitted by the light source is yellow or amber or yellowish-green.

Further, the blowing speed of the cross-flow fan can be selected according to the preference of the user, to form different states of flame.

Further, the blowing speed of the fan is independently controlled and is not affected by the blowing speed of the cross-flow fan. That is, the blowing speed of the fan is not exactly the same as the blowing speed of the cross-flow fan, but a certain change is made according to a certain regular pattern. This will cause different disturbance of the first streamer and the second streamer. A richer natural dithering effect will be created, so that the flame formed by the simulation will not be static, but more flexible and elegant.

Further, the front ends of the first streamer and the second streamer are provided with a translucent screen. The screen is matched and connected with the casing. The setting of the screen can prevent the viewer from directly seeing the edges of the first streamer and the second streamer, making the flame more realistic and three-dimensional.

Further, the surface of the screen is provided with a texture effect, such as brushed or frosted finished, which may diffract the light reflected by the first streamer and the second streamer, so that the light caused by the disturbance of the first streamer and the second streamer is softer, and the edges of the first streamer and the second streamer are more blurred.

Further, the upper half of the screen is provided with a gradient coating that is coated or printed. That is, the lower half of the screen blocks less light and the upper half blocks lighter until it is completely blocked, so that the bottom of the simulated flame is bright and vigorous, and the top of the flame is soft to form a tongue of flame.

The basic principle of the present invention:

In the present invention, the air outlet of the fan is opposite to the section where the air from the cross-flow fan cannot reach the first streamer, that is, the width of the air outlet of the fan can compensate the width of the split joint of the two cross-flow fans, so that air can be blown towards the second streamer.

According to the present invention, the light source is disposed near the first streamer and the second streamer, and the light emitted by the light source is exactly illuminated on the first streamer and the second streamer. The light emitted by the light source is yellow or amber or yellowish-green in color and is similar to the color of a flame.

When in operation, the cross-flow fan and the supplementary air-supplying device (fan) are simultaneously driven to blow towards the first streamer and the second streamer, respectively, and the first streamer and the second streamer are driven by the blowing wind and form random disturbances. When the first streamer and the second streamer are disturbed, the light source emits light to irradiate the first streamer and the second streamer. As the first streamer and the second streamer are light reflective, they can reflect the light emitted by the light source, and the reflected light has the effect of disturbance, thereby simulating the effect of a moving flame.

Compared with the prior art, the present invention has the following beneficial effects:

A streamer type flame simulation device provided by the present invention, since a supplementary air-supplying device is provided between two cross-flow fans for supplying air, the deficiency where air was unable to deliver at the space occupied by the drive motor of the cross-flow fans can be avoided. Various parts of the first streamer and the second streamer can be blown, thus prevents the flame from being cut off and enhances the overall coordination, which greatly improves the viewing effect of the flame area.

Figure 1:
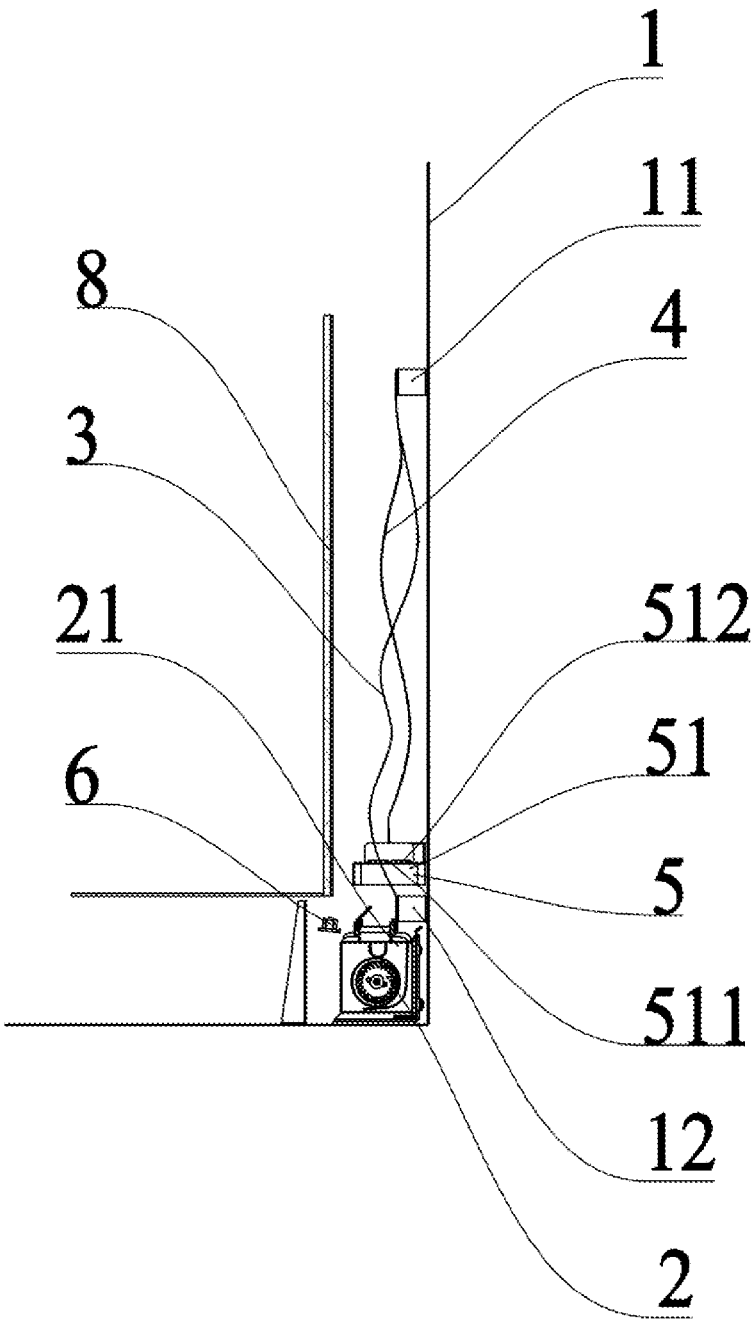
FIG. 1 is a schematic diagram of a half-sectional structure according to Embodiment 1 of the present invention.
Figure 2:
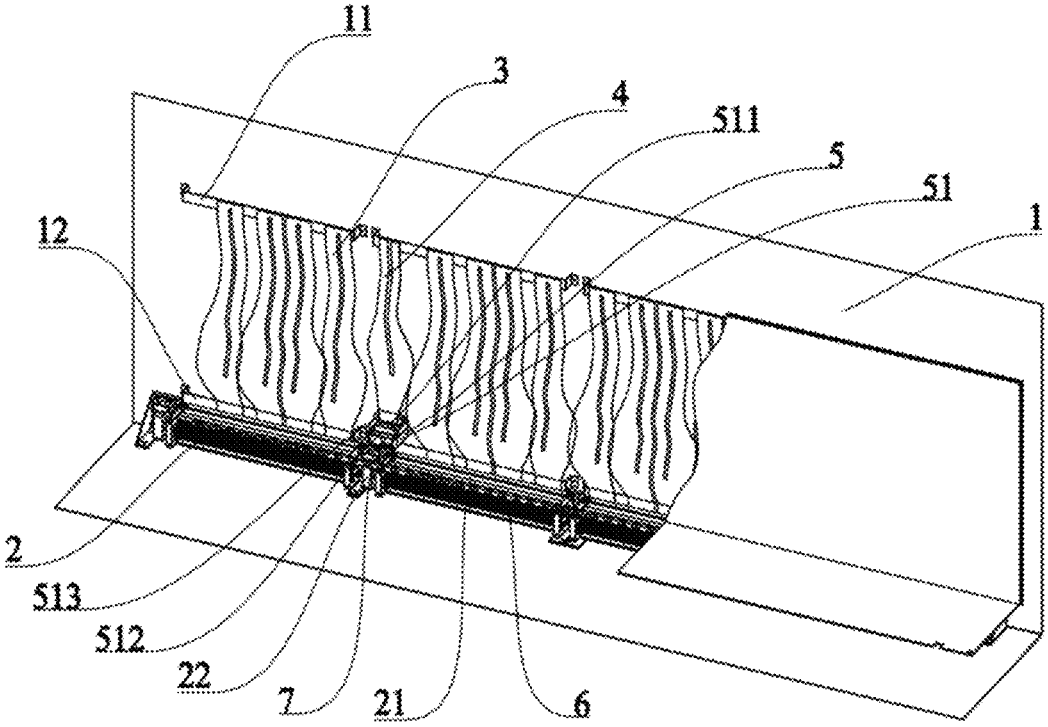
FIG. 2 is a schematic diagram of a three-dimensional structure according to Embodiment 1 of the present invention.
Figure 3:
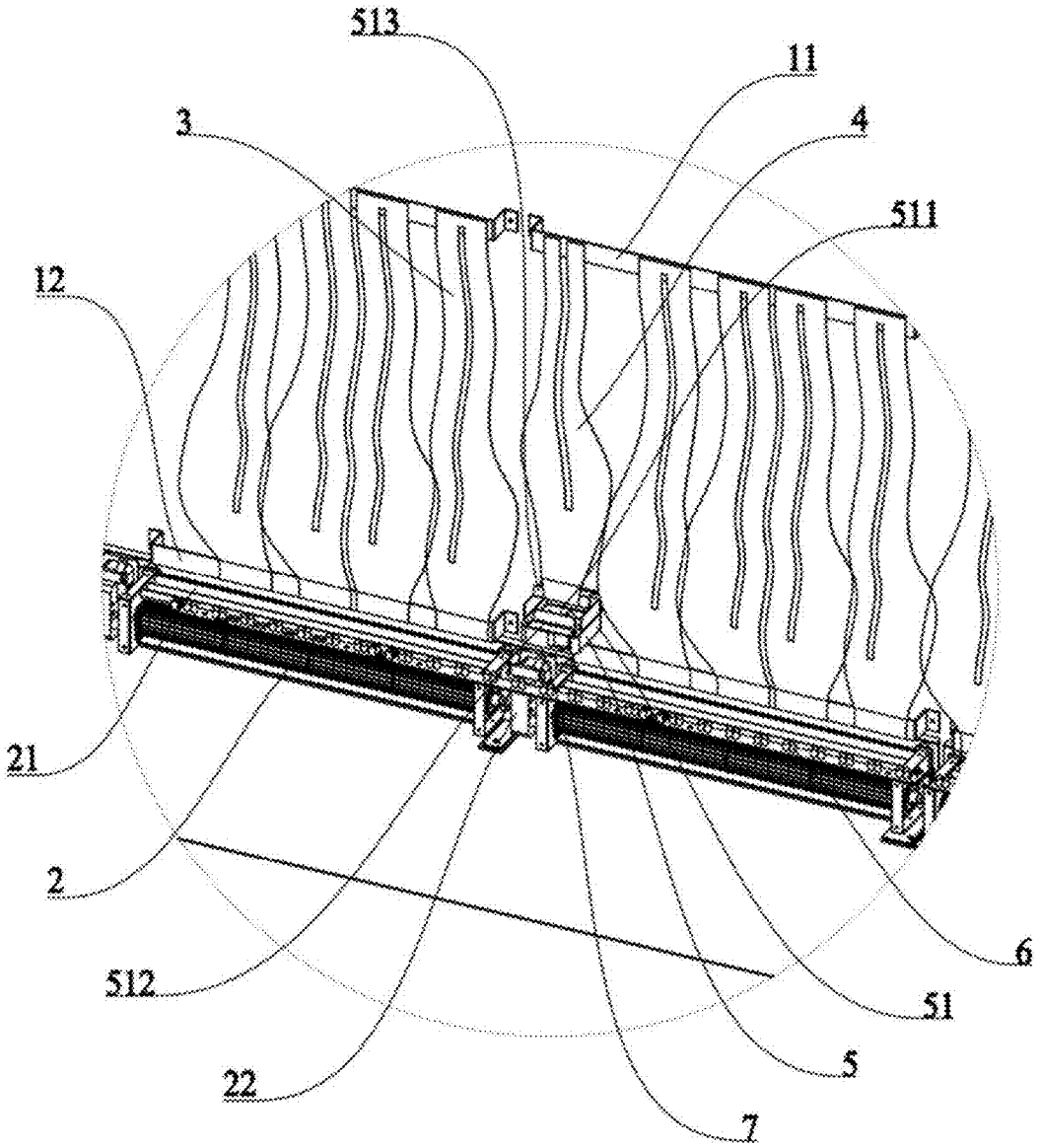
FIG. 3 is a schematic diagram of a partially enlarged structure according to Embodiment 1 of the present invention.
Figure 4:
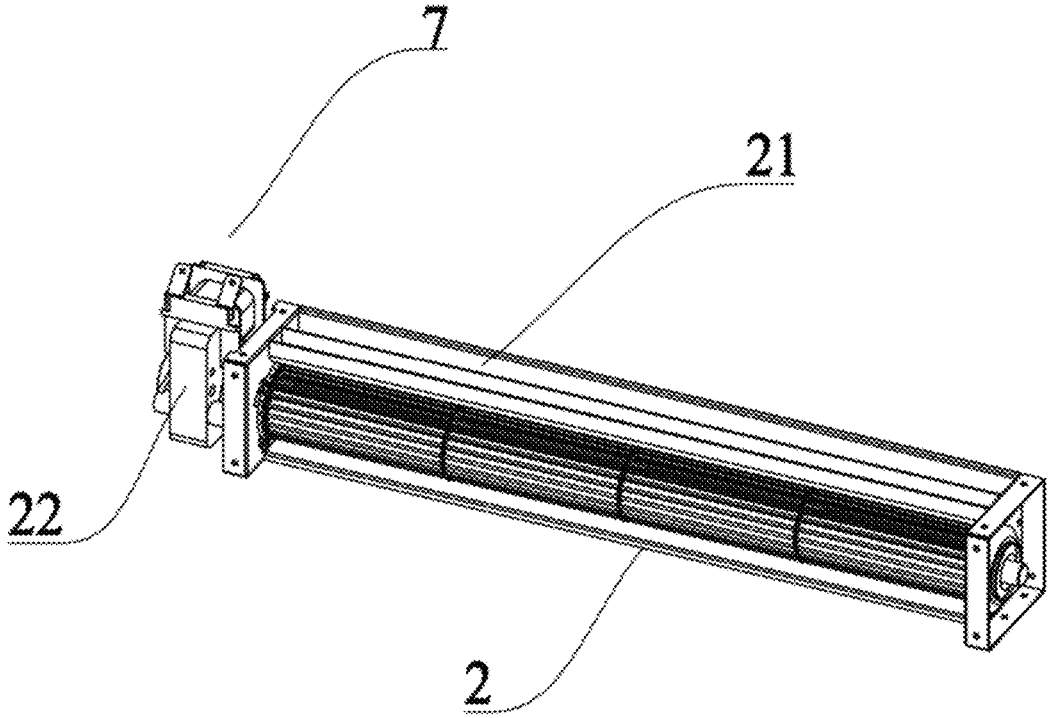
FIG. 4 is a schematic diagram of a cross-flow fan according to Embodiment 1 of the present invention.

The corresponding component names of each reference numeral in the figures are:

| | | |
|---|---|---|
| 1-Casing | 11-Upper bracket | 12-Lower bracket |
| 2-Cross-flow fans | 21-Cross-flow fan air outlet | 22-Cross-flow fan drive motor |
| 3-First streamer | 4-Second streamer | 5-Supplementary air-supplying device |
| 51-Fan | 511-Fan air outlet | 512- Mounting panel |
| 513-Mounting bracket | 6-Light source | 7-Split joint area 8-Screen |

DETAILED DESCRIPTION

To better understand the content of the present invention, a more specific description is given by the following specific embodiments and accompanied figures. It should be understood that these embodiments are only used to further illustrate the present invention, and are not used to limit the scope of the present invention. In addition, it should be understood that after reading the content of the present invention, those skilled in the art may make some nonessential changes or adjustments to the present invention, which still falls within the protection scope of the present invention.

Embodiment 1

A streamer type flame simulation device as shown in FIGS. 1-9, which includes a casing 1, some cross-flow fans 2 disposed inside the casing 1, a first streamer 3, a second streamer 4, a supplementary air-supplying device 5, and a light source 6. There are total of two or more cross-flow fans 2, and there are four in the present embodiment. The first streamer 3 is a series of strips arranged vertically according to the width direction, and the cross-flow fans 2 are arranged along the width of the first streamer 3. The second streamer 4 is a strip. The supplementary air-supplying device 5 is arranged in the split joint area 7 between the two cross-flow fans 2. The cross-flow fans 2 blow air to the first streamer 3, and the supplementary air-supplying device 5 blows air to the second streamer 4. The light emitted from the light source 6 is directed towards the first streamer 3 and the second streamer 4.

The supplementary air-supplying device 5 is a fan 51.

Figure 5:
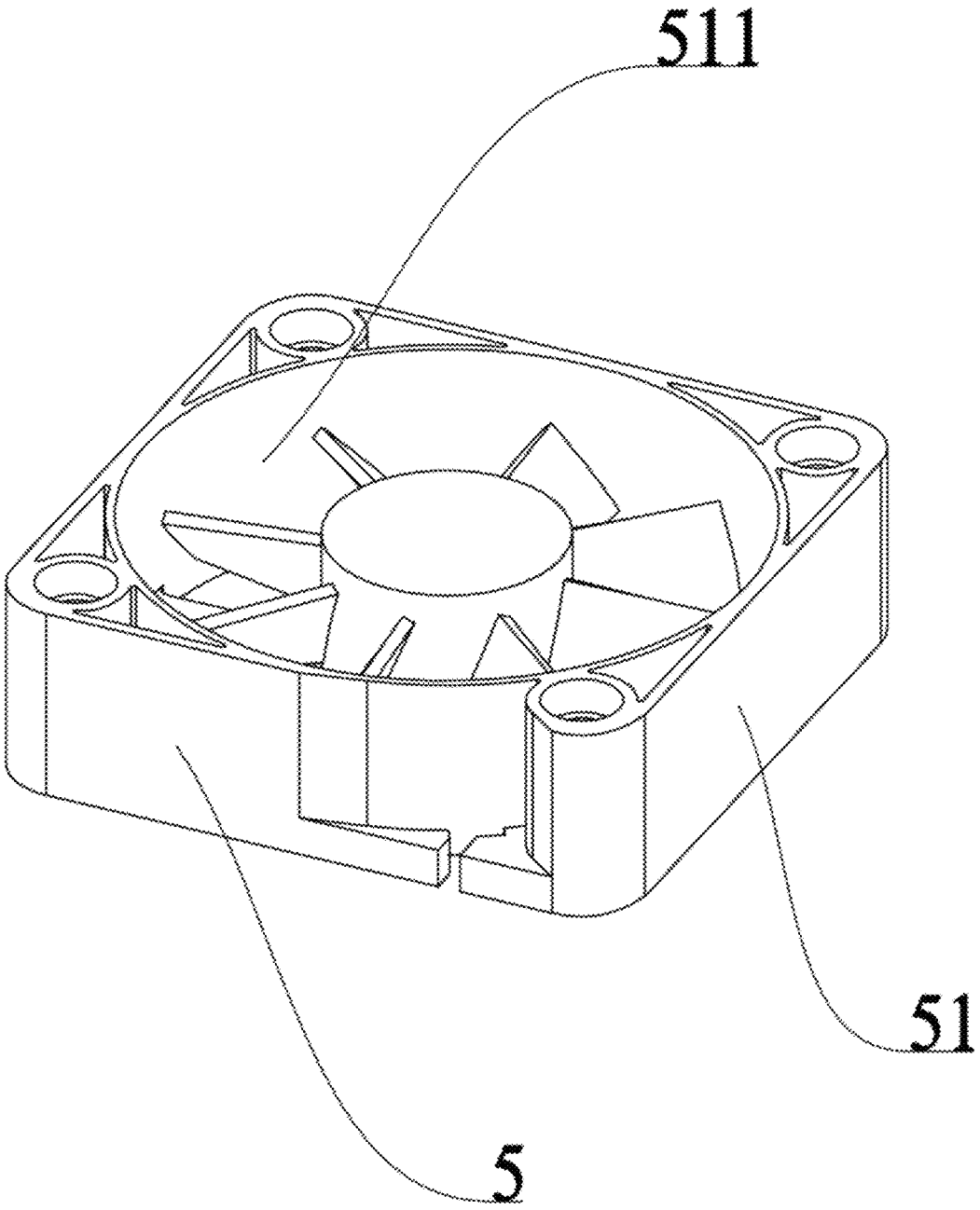
FIG. 5 is a schematic diagram of a fan according to Embodiment 1 of the present invention.
Figure 6:
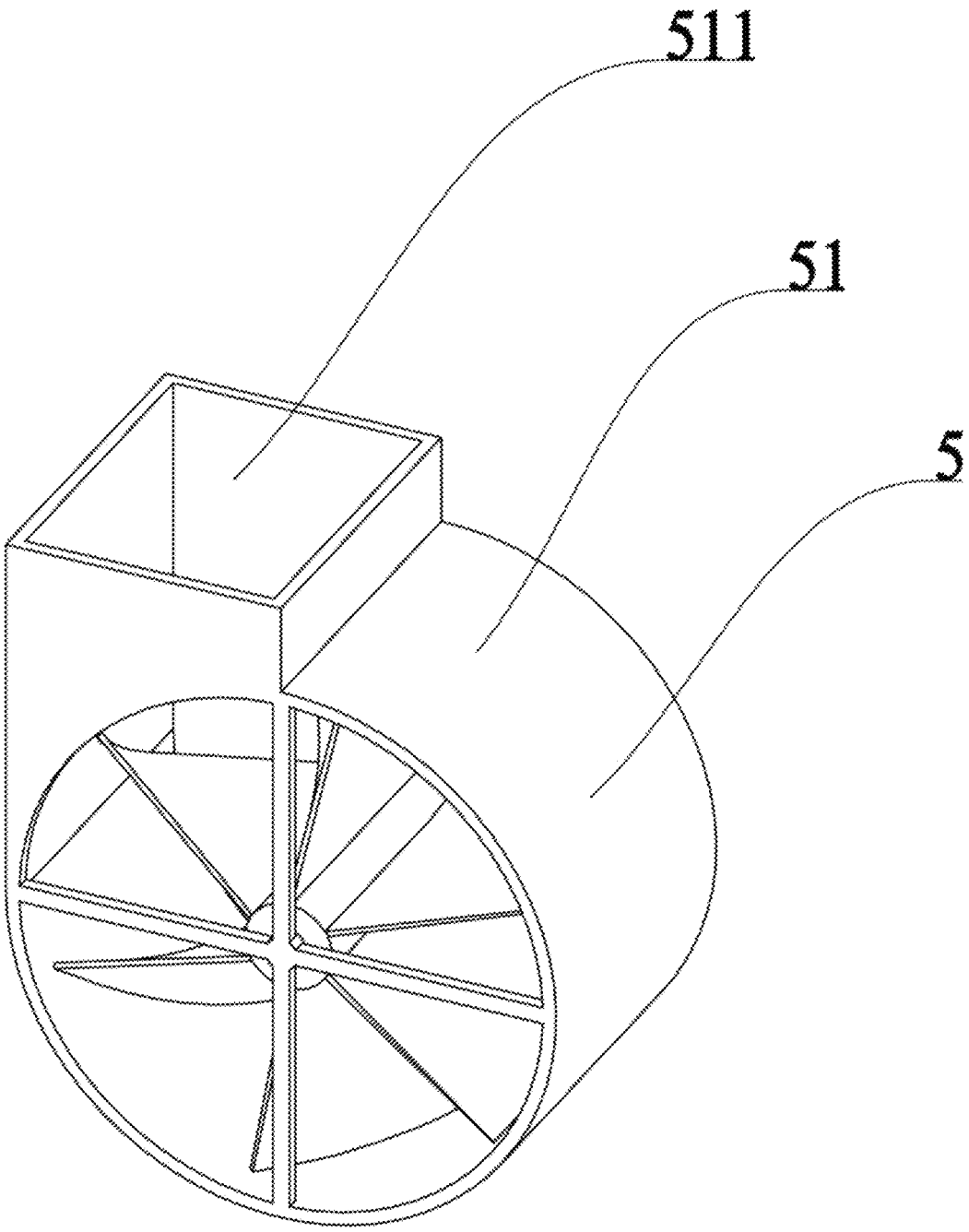
FIG. 6 is another schematic diagram of a fan according to Embodiment 1 of the present invention.
Figure 7:
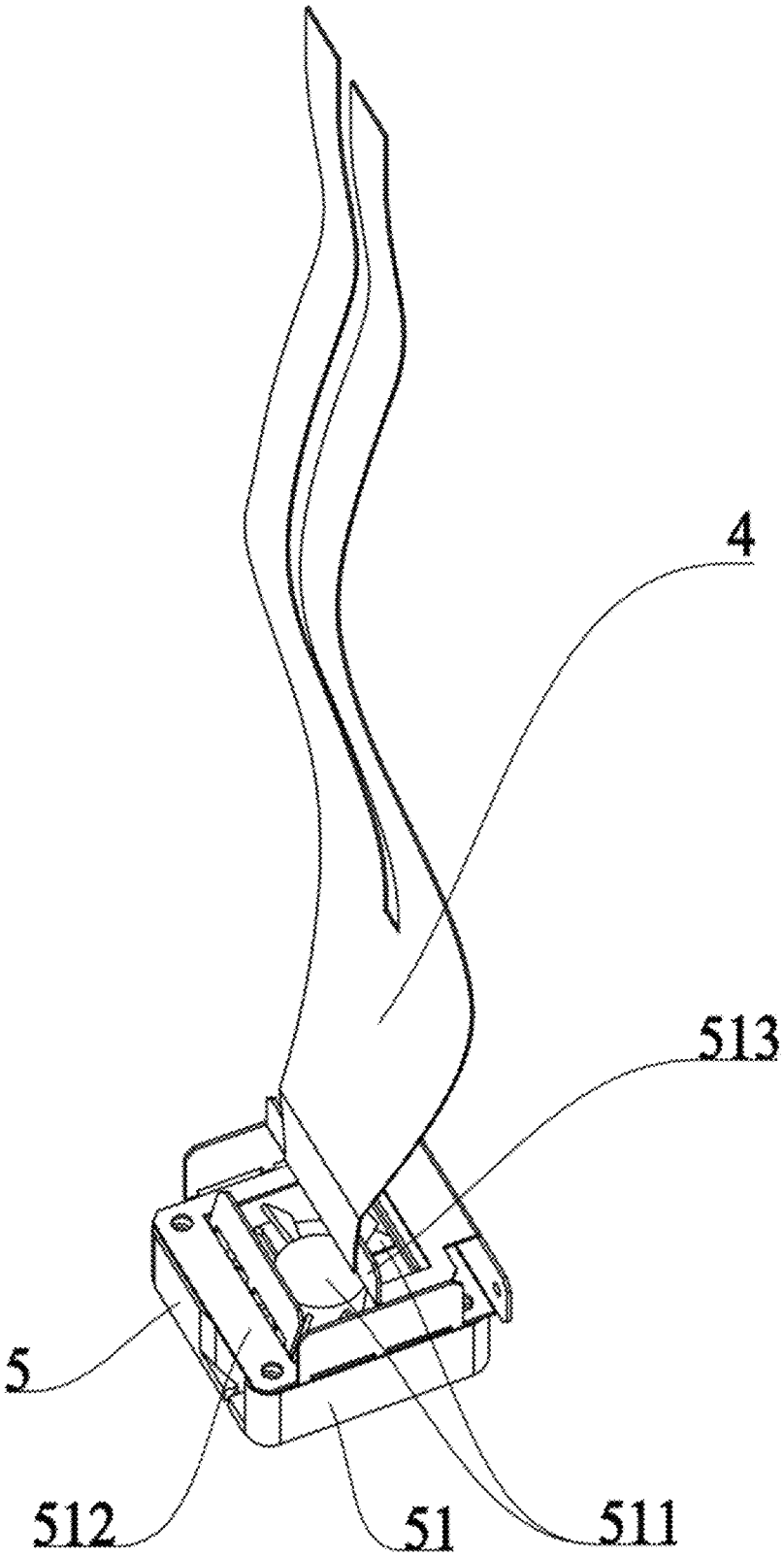
FIG. 7 is a schematic diagram showing the installation position of a fan and a streamer according to Embodiment 1 of the present invention.
Figure 8:
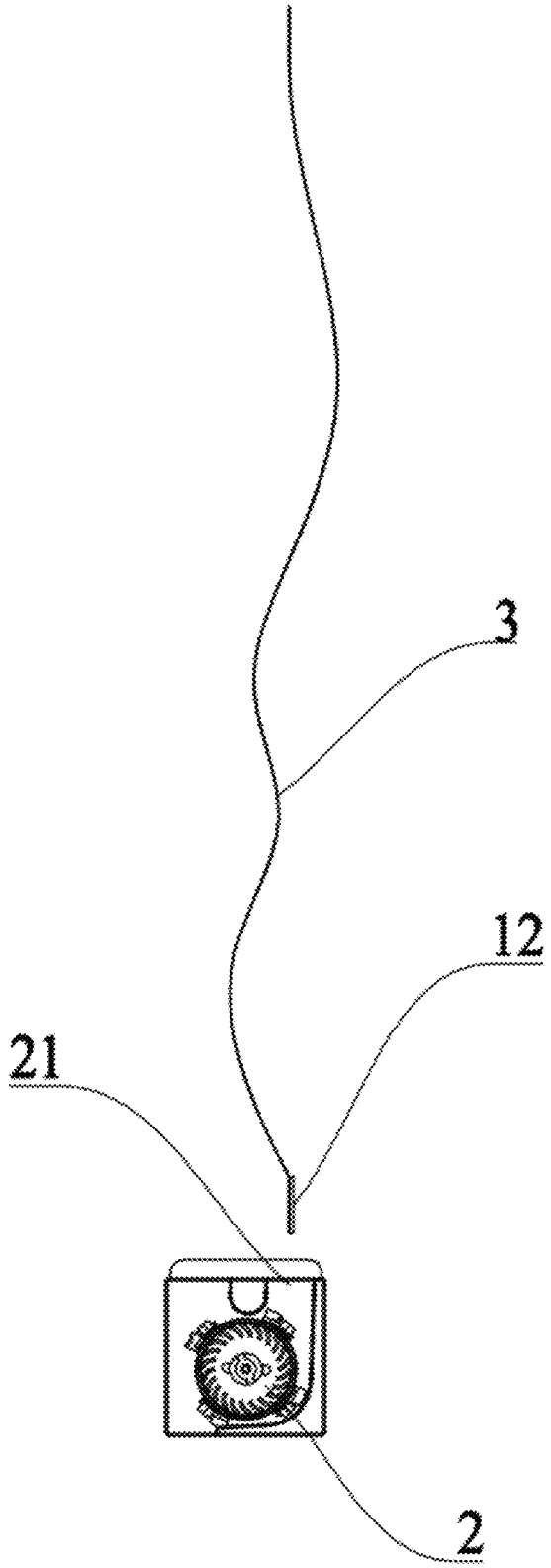
FIG. 8 is a schematic diagram showing the installation position of the cross-flow fan and the streamer according to Embodiment 1 of the present invention.
Figure 9:
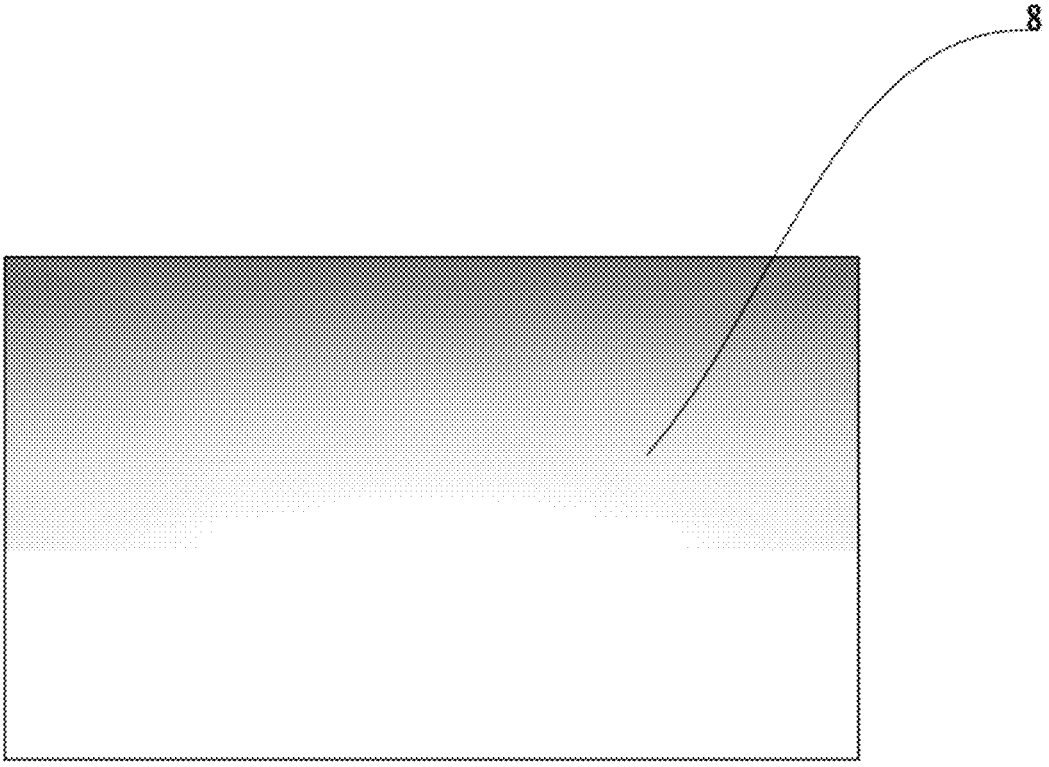
FIG. 9 is a schematic diagram of a printed pattern of screen according to Embodiment 1 of the present invention.

The fan 51 is either a centrifugal fan, an axial fan, a diagonal fan, or a cross-flow fan. Preferably, it is a centrifugal fan (as shown in FIG. 5) or an axial fan (as shown in FIG. 6).

The first streamer 3 and/or the second streamer 4 are respectively made of flexible materials.

The surface of the first streamer 3 and/or the second streamer 4 has a light reflection effect.

The cross-flow fans 2 are matched and connected with the bottom plate of the casing 1. The cross-flow fans 2 are disposed below the first streamer 3.

An upper bracket 11 and a lower bracket 12 are respectively provided on the upper and lower portions of the back plate of the casing 1. The upper end of the first streamer 3 is matched and connected with the upper bracket 11. The lower end of the first streamer 3 is matched and connected with the lower bracket 12.

The cross-flow fan 2 includes a cross-flow fan air outlet 21. The first streamer 3 faces the middle of the cross-flow fan air outlet 21. That is, when the cross-flow fan 2 blows toward the first streamer 3, there is an air flow in front and at the back of the first streamer 3, and the speed of air flow obtained at the lower end of the first streamer 3 is stable, but the disturbance caused by air flow at the upper end is stronger, so that a better simulation of flame with steady combustion effect at the bottom is achieved, and the top of the flame is agile and elegant.

The cross-flow fan 2 includes a cross-flow fan drive motor 22 disposed beside the cross-flow fan air outlet 21. The split joint area 7 includes the upper side of the area where the cross-flow fan drive motor 22 is located.

The fan 51 is matched and connected with the back plate of the casing 1.

The fan 51 is disposed below the second streamer 4.

The fan 51 includes a fan air outlet 511 and a mounting panel 512 that is matched and connected with the fan air outlet 511. A mounting bracket 513 is provided in the middle of the mounting panel 512. The lower end of the second streamer 4 is matched and connected with the mounting bracket 513. The fan 51 blows towards the front and rear portions of the second streamer 4.

The upper end of the second streamer 4 is matched and connected with the upper mounting bracket 11.

The width of the fan air outlet 511 is less than or equal to the width of the split joint area 7.

There are two or more light sources 6.

The light sources 6 are independently controlled, and each of the light sources 6 can emit light of different colors and brightness. Through the combination of controlling two or more light sources 6 with different colors and brightness, different flame effects are formed.

When working stably, the brightness and color of light sources 6 dynamically change according to a certain regular pattern, so that a dynamic flickering effect of the burning flame can be formed.

The color of the light emitted by the light source 6 is similar to the color of a flame. The color of the light emitted by the light source 6 is yellow or amber or yellowish-green. The light source 6 is disposed obliquely below the first streamer 3 and the second streamer 4.

The blowing speed of the cross-flow fan 2 can be selected according to the preference of the user, to form different states of flame.

The blowing speed of the fan 51 is independently controlled and is not affected by the blowing speed of the cross-flow fan 2. That is, the blowing speed of the fan 51 is not exactly the same as the blowing speed of the cross-flow fan 2, but a certain change is made according to a certain regular pattern. This will cause different disturbance of the first streamer 3 and the second streamer 4. A richer natural dithering effect will be created, so that the flame formed by the simulation will not be static, but more flexible and elegant.

The front ends of the first streamer 3 and the second streamer 4 are provided with a translucent screen 8. The screen 8 is matched and connected with the casing 1. The setting of the screen 8 can prevent the viewer from directly seeing the edges of the first streamer 3 and the second streamer 4, making the flame more realistic and three-dimensional.

The surface of the screen 8 is provided with a texture effect, such as brushed or frosted finished, which may diffract the light reflected by the first streamer 3 and the second streamer 4, so that the light caused by the disturbance of the first streamer 3 and the second streamer 4 is softer, and the edges of the first streamer 3 and the second streamer 4 are more blurred.

The upper half of the screen 8 is provided with a gradient coating that is coated or printed. That is, the lower half of the screen 8 blocks less light and the upper half blocks more light until it is completely blocked, so that the bottom of the simulated flame is bright and vigorous, and the top of the flame is soft to form a tongue of flame.

In the present invention, the cross-flow fan air outlets 21 blow air to the first streamer 3. A fan 51 is provided at the joining part of two cross-flow fans 2. The deficiency where air was unable to deliver at the space occupied by the drive motor 22 of the cross-flow fans can be avoided. Thus, various parts of the first streamer 3 and the second streamer 4 can be blown, therefore forming disturbance. The light emitted from the light source 6 is directed towards the first streamer 3 and the second streamer 4 and is reflected, thereby a moving flame is simulated. The setting of fan 51 prevents the flame from being cut off and enhances its overall coordination, which greatly improves the viewing effect of the flame area.

The working process of the present embodiment:

When in operation, the cross-flow fan 2 and the supplementary air-supplying device 5 (fan 51) are simultaneously driven to blow towards the first streamer 3 and the second streamer 4, respectively, and the first streamer 3 and the second streamer 4 are driven by the blowing wind and form random disturbances. When the first streamer 3 and the second streamer 4 are disturbed, the light source 6 emits light to irradiate the first streamer 3 and the second streamer 4. As the first streamer 3 and the second streamer 4 are light reflective, they can reflect the light emitted by the light source 6, and the reflected light has the effect of disturbance, thereby simulating the effect of a moving flame. The translucent screen 8 is set in a way that the light is diffracted due to its texture effect. The edges of the first streamer 3 and the second streamer 4 cannot be seen directly, the flame effect is softer, and the upper part of the screen 8 is printed with gradient coating which makes the top portion of the flame much weakened, so that a brighter lower half and a dim upper half flame is produced. When the cross-flow fan 2 and the fan 51 are driven to supply air, the wind speed of the cross-flow fan 2 and the wind speed of the fan 51 are not exactly the same, but are dynamically matched, so that the simulated flame will not be static but more agile and elegant. And the light source 6 emits a simulated flame of various colors, making it more colorful with varying brightness.

The above description is not a limitation to the present invention, and the present invention is not limited to the above examples. Changes, modifications, additions or replacements made by those skilled in the art within the substantial scope of the invention shall also fall within the protection scope of the present invention.

What is claimed is:

1. A streamer type flame simulation device, comprising a casing, two or more cross-flow fans disposed inside the casing, a first streamer, a second streamer, a supplementary air-supplying device, and a light source;

wherein:

the first streamer is a series of strips arranged vertically according to a width direction, and the cross-flow fans are arranged along the width of the first streamer;

the second streamer is a strip;

the supplementary air-supplying device is arranged in a split joint area between two adjacent cross-flow fans of the two or more cross-flow fans;

the two or more cross-flow fans blow air to the first streamer, and the supplementary air-supplying device blows air to the second streamer; and light emitted from the light source is directed towards the first streamer and the second streamer;

an air outlet of the supplementary air-supplying device is opposite to a section where the air from the two or more cross-flow fans cannot reach the first streamer, a width of the air outlet of the supplementary air-supplying device can compensate a width of the split joint area of the two adjacent cross-flow fans;

the two or more cross-flow fans and the supplementary air-supplying device are simultaneously driven to blow towards the first streamer and the second streamer, respectively, and the first streamer and the second streamer are driven by a blowing wind and form random disturbances; and a blowing speed of the two or more cross-flow fans and a blowing speed of the supplementary air-supplying device are dynamically matched.

2. The streamer type flame simulation device according to claim 1, wherein the supplementary air-supplying device is a fan.

3. The streamer type flame simulation device according to claim 2, wherein the fan is matched and connected with a back plate of the casing; and the fan is disposed below the second streamer.

4. The streamer type flame simulation device according to claim 3, wherein the air outlet of the supplementary air-supplying device is a fan air outlet and a mounting panel that is matched and connected with the fan air outlet; and wherein a mounting bracket is provided in a middle of the mounting panel; and a lower end of the second streamer is matched and connected with the mounting bracket.

5. The streamer type flame simulation device according to claim 4, wherein the width of the fan air outlet is less than or equal to the width of the split joint area.

6. The streamer type flame simulation device according to claim 1, wherein the first streamer and/or the second streamer are respectively made of flexible materials.

7. The streamer type flame simulation device according to claim 1, wherein a surface of the first streamer and/or the second streamer has a light reflection effect.

8. The streamer type flame simulation device according to claim 1, wherein the two or more cross-flow fans are matched and connected with a bottom plate of the casing; and the two or more cross-flow fans are disposed below the first streamer.

9. The streamer type flame simulation device according to claim 1, further comprising an upper bracket and a lower bracket, wherein the upper bracket and the lower bracket are respectively provided on upper and lower portions of a back plate of the casing; the upper end of the first streamer is matched and connected with the upper bracket; and the lower end of the first streamer is matched and connected with the lower bracket.

10. The streamer type flame simulation device according to claim 1, wherein each of the two or more cross-flow fans further comprises a cross-flow fan air outlet; wherein the first streamer faces a middle of the cross-flow fan air outlet.

11. The streamer type flame simulation device according to claim 10, wherein the two or more cross-flow fans further comprise across-flow fan drive motor disposed beside the cross-flow fan air outlet; and the split joint area includes an upper side of an area where the cross-flow fan drive motor is located.

12. The streamer type flame simulation device according to claim 1, wherein there are two or more light sources.

13. The streamer type flame simulation device according to claim 12, wherein the light sources are independently controlled, and each of the light sources can emit light of different colors and brightness.

14. The streamer type flame simulation device according to claim 13, wherein, when working stably, the brightness and color of the light sources dynamically change according to a certain regular pattern, so that a dynamic flickering effect of a burning flame can be formed.

15. The streamer type flame simulation device according to claim 1, wherein a color of the light emitted by the light source is similar to a color of a flame.

16. The streamer type flame simulation device according to claim 1, wherein the blowing speed of each of the two or more cross-flow fans can be selected according to the preference of the user.

17. The streamer type flame simulation device according to claim 1, wherein front ends of the first streamer and the second streamer are provided with a translucent screen; and the screen is matched and connected with the casing.

18. The streamer type flame simulation device according to claim 17, wherein a surface of the screen is provided with a texture effect.

19. The streamer type flame simulation device according to claim 18, wherein an upper half of the screen is provided with a gradient coating that is coated or printed.

* * * * *